US005850125A

United States Patent [19]

Jae et al.

[11] Patent Number: 5,850,125

[45] Date of Patent: Dec. 15, 1998

[54] PSEUDOSPARK SWITCH HAVING AN INSULATOR BETWEEN ELECTRODES

[75] Inventors: Hwan-Young Jae; Byung-Ho Sung, both of Seoul; Kyu-Hwan Lim, Kyunggi-do; Hyun-Kuk Shin; Jae-Hyun Sim, both of Seoul, all of Rep. of Korea

[73] Assignee: Soosan Special Purpose Vehicle Co., Ltd., Chungnam, Rep. of Korea

[21] Appl. No.: 756,579

[22] Filed: Nov. 27, 1996

[30] Foreign Application Priority Data

Nov. 28, 1995 [KR] Rep. of Korea ..... 1995 44066

[51] Int. Cl.[6] ..... H01J 17/48; H01J 17/00; H01J 61/00; H01J 17/26

[52] U.S. Cl. ..... 313/589; 313/231.41; 313/590

[58] Field of Search ..... 313/231.41, 589, 313/590, 603, 604, 609, 618

[56] References Cited

U.S. PATENT DOCUMENTS

| | | | |
|---|---|---|---|
| 4,532,219 | 7/1985 | Hagen et al. | 313/231.41 |
| 4,647,818 | 3/1987 | Ham | 313/231.41 |
| 4,939,416 | 7/1990 | Seeboeck et al. | 313/590 |
| 5,007,373 | 4/1991 | Legg et al. | 313/231.41 |
| 5,075,592 | 12/1991 | Seeboeck et al. | 313/590 |
| 5,091,819 | 2/1992 | Christiansen et al. | 313/231.41 |
| 5,126,638 | 6/1992 | Dethlefsen | 313/231.41 |
| 5,407,645 | 4/1995 | Daeumer et al. | 313/609 |

*Primary Examiner*—William L. Oen

*Attorney, Agent, or Firm*—Oblon, Spivak, McClelland, Maier & Neustadt, P.C.

[57] ABSTRACT

A pseudospark switch including an insulator which can withstand high temperature plasma and is arranged between both electrodes thereof, thereby being capable of preventing the electrodes from being damaged while allowing a large amount of charge to flow instantaneously. The high power pseudospark switch includes first and second hollow electrodes facing each other, the hollow electrodes being open at facing ends thereof and closed at opposite ends thereof, respectively, an inert gas inlet port provided at the closed end wall of the first hollow electrode, a vacuum pump connecting port provided at the closed end wall of the second hollow electrode, a first electrode arranged at the open end of the first hollow electrode, a second electrode arranged at the open end of the second hollow electrode in such a manner that it faces the first electrode, and an insulator interposed between the first and second electrodes.

4 Claims, 2 Drawing Sheets

PSEUDOSPARK SWITCH HAVING AN INSULATOR BETWEEN ELECTRODES

BACKGROUND OF THE INVENTION

1. Field of the Invention

The present invention relates to a pseudospark switch utilizing pseudospark, and more particularly to a pseudospark switch including an insulator which can withstand high temperature plasma and is arranged between both electrodes thereof, thereby being capable of preventing the electrodes from being damaged while allowing a large amount of charge (at least 100 Coulomb flow instantaneously.

2. Description of the Prior Art

The breakdown voltage of gas between two parallel electrodes in a confined space is a function of the product of the gas pressure and the distance between the electrodes. This is known as Paschen's law.

Pseudospark is a discharge which occurs on the left portion of Paschen's Curve if the Paschen's Curve is divided at the Paschen's minimum. In other words, the discharge exhibits a characteristic in that a decrease in breakdown voltage occurs when an increase in gas pressure occurs. In a normal sparking, such a decrease in breakdown voltage occurs when the gas pressure decreases.

Such a pseudospark occurs in a gas between a hollow cathode and an anode. The pseudospark is utilized in switches of pulse generating devices using high voltage and a large amount of current because it makes a large amount of charge flow instantaneously. The pulse generating devices are mainly used for lasers, radars and particle accelerators.

However, involved with know pseudospark switches is the damaging of electrodes occurring when a large amount of charge flows. As a result, the life of such pseudospark switches is shortened. Furthermore, an evaporation of metal occurs at the electrodes. This results in a decrease in breakdown voltage. Consequently, the pseudospark switches are improper for the purpose of making a large amount of charge flow.

SUMMARY OF THE INVENTION

Therefore, an object of the invention is to solve the above-mentioned problems involved in conventional pseudospark switches and to provide a high power pseudospark switch capable of allowing a large amount of charge flow at high voltage.

In accordance with the present invention, this object is accomplished through a high power pseudospark switch comprising: first and second hollow electrodes facing each other, the hollow electrodes being open at facing ends thereof and closed at opposite ends thereof, respectively; an inert gas inlet port provided at the closed end wall of the first hollow electrode; a vacuum pump connecting port provided at the closed end wall of the second hollow electrode; a first electrode arranged at the open end of the first hollow electrode; a second electrode arranged at the open end of the second hollow electrode in such a manner that it faces the first electrode; and an insulator interposed between the first and second electrodes.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
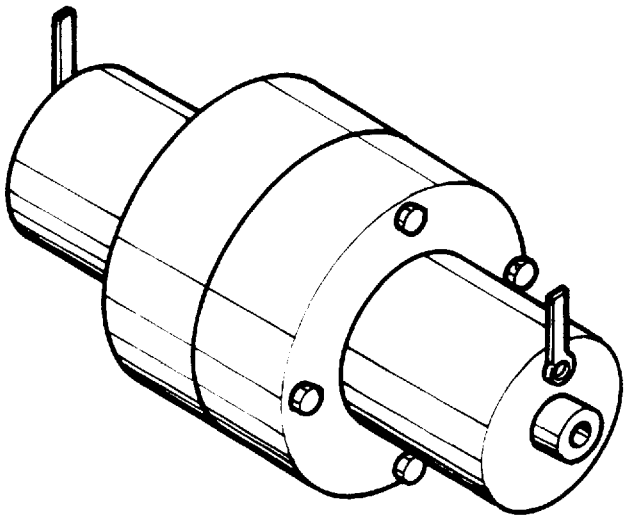
FIG. 1 is a perspective view illustrating the appearance of a high power pseudospark switch in accordance with the present invention.

A high power pseudospark switch according to the present invention will now be described in conjunction with FIGS. 1 and 2.

Figure 2:
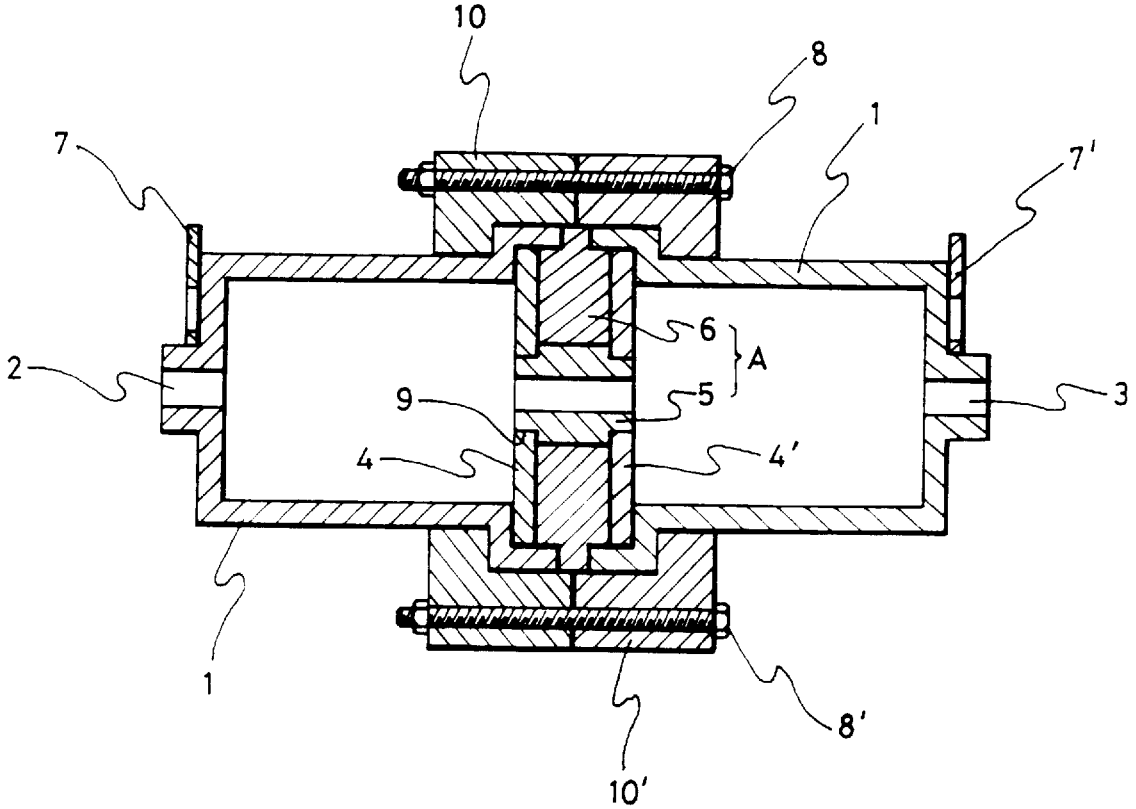
FIG. 2 is a sectional view illustrating the construction of the high power pseudospark switch in accordance with the present invention.

As shown in FIG. 2, the high power pseudospark switch of the present invention includes a first hollow electrode 1 and a second hollow electrode 1' facing each other. The hollow electrodes 1 and 1' are open at their facing ends and closed at their opposite ends, respectively. An inert gas inlet port 2 is provided at the closed end wall of the first hollow electrode 1 whereas a vacuum pump connecting port 3 is provided at the closed end wall of the second hollow electrode 1'. The high power pseudospark switch also includes a first electrode 4 arranged at the open end of the first hollow electrode 1 and a second electrode 4' arranged at the open end of the second hollow electrode 1 in such a manner that it faces the first electrode 4. An insulator A is interposed between the first and second electrodes 4 and 4'.

In accordance with the present invention, the first and second hollow electrodes 1 and 1' are made of stainless steel whereas the first and second electrodes 4 and 4' are made of a copper-tungsten or silver-tungsten alloy exhibiting a high resistance against arc and have a disc shape. On the other hand, the insulator A includes a ceramic ring 5 and a TEFLON polymer disc 6 fitting around the ceramic ring 5.

The ceramic ring 5 is provided at its opposite ends with flanges 9 respectively adapted to protect the first and second electrodes 4 and 4'. The ceramic ring 5 has a throughout hole serving to communicate the interior of the first hollow electrode 1 with the interior of the second hollow electrode 1'.

In FIG. 2, the reference numerals 7 and 7' denote electrode terminals respectively provided at the first and second hollow electrodes 1 and 1'.

Now, the operation of the high power pseudospark switch having the above-mentioned construction will be described.

When a voltage lower than the breakdown voltage is applied between the first and second hollow electrodes in a state wherein the gas pressure exerted in the interior of the first and second hollow electrodes 1 and 1', a strong electric field is formed between the first and second electrodes 4 and 4'.

When inert gas is introduced into the interior of the first and second hollow electrodes 1 and 1' through the gas inlet port 2 under the condition in which the strong electric field is formed between the first and second electrodes 4 and 4', the gas pressure in the interior of the first and second hollow electrodes 1 and 1' increases, thereby causing the breakdown voltage to decrease to a level lower than the applied voltage. As a result, the gas existing in the interior of the first and second hollow electrodes 1 and 1' is ionized, so that current can flow through the throughout hole of the ceramic ring 5 by virtue of the presence of the insulator A.

In this case, the breakdown voltage of the pseudospark switch is a function of the product of the gas pressure in the interior of the first and second hollow electrodes 1 and 1' and the distance between the first and second electrodes 4 and 4'.

The amount of flowable charge increases proportionally to the size of the throughout hole centrally provided at the ceramic ring 5.

The inert gas introduced in the interior of the first and second hollow electrodes 1 and 1' through the gas inlet port 2 serves to initiate the discharge of the pseudospark switch. In other words, the inert gas serves to trigger the switch. The inert gas also functions to discharge impurities formed in the interior of the first and second hollow electrodes 1 and 1' through the vacuum pump connecting port 3.

The ceramic ring 5 and teflon disc 6 serve to flow a large amount of charge through the throughout hole provided at the ceramic ring 5. The flanges 9 provided at the opposite ends of the ceramic ring 5 protect the first and second electrodes 4 and 4' from high temperature plasma.

As apparent from the above description, the present invention provides a high power pseudospark switch including an insulator which can withstand high temperature plasma and is arranged between both electrodes thereof, thereby being capable of preventing the electrodes from being damaged while allowing a large amount of charge to flow instantaneously. Accordingly, it is possible to lengthern the life of the pseudospark switch.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A high power pseudospark switch comprising:

first and second hollow electrodes which are adjacent at one end, the hollow electrodes being open at the adjacent ends thereof and closed at opposite ends thereof, respectively;

an inert gas inlet port provided at the closed end of the first hollow electrode;

a vacuum pump connecting port provided at the closed end of the second hollow electrode;

a first electrode arranged at the open end of the first hollow electrode;

a second electrode arranged at the open end of the second hollow electrode, the second electrode facing the first electrode; and an insulator interposed between the first and second electrodes said insulator covering facing surfaces and end surfaces of the first and second electrodes.

2. The high power pseudospark switch in accordance with claim 1, wherein the insulator comprises a ceramic ring and a TEFLON polymer disc fitting around the ceramic ring.

3. The high power pseudospark switch in accordance with claim 1, wherein the first and second electrodes are made of a copper-tungsten or silver-tungsten alloy exhibiting a high resistance against arc and have a disc shape with central through holes.

4. The high power psuedospark switch in accordance with claim 2, wherein the ceramic ring is provided at opposite ends thereof with flanges, respectively.

* * * * *